United States Patent [19]

Grossman

[11] 4,126,141

[45] Nov. 21, 1978

[54] FILTER AND CIGARETTE INCLUDING A FILTER

[75] Inventor: Harold Grossman, Upper Montclair, N.J.

[73] Assignee: Montclair Research Corporation, Silver Spring, Md.

[21] Appl. No.: 757,143

[22] Filed: Jan. 6, 1977

Related U.S. Application Data

[62] Division of Ser. No. 562,214, Mar. 26, 1975, abandoned.

[51] Int. Cl.[2] ..... A24D 1/00; A24D 1/00; A24B 15/00

[52] U.S. Cl. ..... 131/9; 131/17 R; 55/524; 55/528

[58] Field of Search ..... 131/9, 15 R, 10.7, 10.9, 131/261 R, 264–269, 17, 15; 55/524, 526

[56] References Cited

U.S. PATENT DOCUMENTS

| | | | |
|---|---|---|---|
| 2,003,690 | 6/1935 | Lewton | 131/17 R |
| 3,087,500 | 4/1963 | Jacobson | 131/265 |

FOREIGN PATENT DOCUMENTS

| | | | |
|---|---|---|---|
| 752,358 | 7/1956 | United Kingdom | 131/266 |

*Primary Examiner*—Robert W. Michell
*Assistant Examiner*—V. Millin
*Attorney, Agent, or Firm*—Shapiro and Shapiro

[57] ABSTRACT

A filter for tobacco smoke comprises a porous substrate (other than tobacco) having a deposit thereon of particles of a water-insoluble hydrophobic moisture-laden substance, the major ingredient of the substance being water, which is activated by the smoke of burning tobacco to release the moisture. The filter may be in the form of a cartridge for insertion in a cigarette or cigar holder or as a filter tip made integral with a body of divided tobacco.

26 Claims, 5 Drawing Figures

FILTER AND CIGARETTE INCLUDING A FILTER

This is a division of application Ser. No. 562,214, filed Mar. 26, 1975, now abandoned.

The invention relates to improvements in a filter for tobacco smoke, and to the combination of the filter with a body of tobacco which may be in divided form as in a cigarette.

BACKGROUND OF THE INVENTION

It has long been recognized that the presence of moisture furnishes a cool, comparatively smooth smoke. It has also been suggested that the presence of moisture acts to condense some of the tars in the stream of tobacco smoke.

There is presently on the market a product called "Aqua Filter" which comprises a cigarette holder containing a filter or cartridge which is prewet with a fluid containing water. In order that the fluid or water shall not evaporate between the time of manufacture and the time of use, the reservoir, container or cigarette holder having the filter therein has its ends sealed by an insert at the cigarette end and a plastic top at the mouthpiece end. These parts must be removed at the time the holder is used for the smoking of a cigarette. Also, the manufacturer recognizes that the seal provided at each end of the holder may not be effective, and it is suggested that if some of the moisture has evaporated when the product is ready for use, the filter insert may be re-moistened by putting the large end under a faucet. It will be apparent that it is essential to provide suitable means for sealing in order not to lose the fluid or moisture by evaporation or otherwise. The provision of the sealing means involves the cost of the parts and the cost of assembling the parts with the cigarette holder. Moreover, according to one of the patents pertaining to the product described above (U.S. Pat. No. 3,048,180), filter tips integral with the cigarettes cannot of necessity be readily formed as hygroscopic filters. The product described above and in the aforementioned patent is considered a hygroscopic filter.

SUMMARY OF THE INVENTION

In accordance with the invention, a filter for tobacco smoke is provided which contains a substance which is normally dry but which is laden with moisture and activated by the tobacco smoke to release the moisture. The filter may be in the form of a cartridge for a cigarette or cigar holder, or as a filter tip associated or made integral with a body of divided or shredded tobacco to be burned. The substance also is water-insoluble and hydrophobic. Preferably, the substance is a colloidal methylated silica-water system with the particles of methylated silica deposited around a mist of dispersed water.

The substance as above described which is activated by the tobacco smoke to release the moisture is carried by a porous substrate other than tobacco; that is cellulosic material such as cellulose acetate tow, cotton fibers, or the like, or mixture thereof.

Where the filter of the invention is positioned as the tip of a body of divided tobacco to furnish a cigarette, it is preferred that the tobacco also have a deposit thereon of the water-insoluble, hydrophobic, moisture-laden substance. The temperature of burning of the tobacco activates the substance to release moisture and to additionally furnish a cool smoke. Also, any condensation of the tars and nicotines caused by the release of the moisture and the consequent cooling is enhanced by the inclusion of the substance in the tobacco as well. Further, by selecting a substance which serves to additionally impart a negative charge to the particles in the smoke, a substantial elimination of the tars and nicotines carried in the smoke stream is accomplished by additionally including a fiber or material in the filter end of the cigarette which has a positive zeta potential at the pH of tobacco smoke.

These, and other objects and advantages of the invention will be apparent from the following detailed description taken in conjunction with the drawings.

DESCRIPTION OF THE PREFERRED EMBODIMENTS

Figure 1:
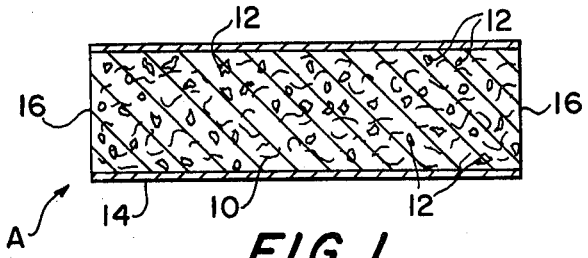
FIG. 1 is a vertical cross section of a filter in the form of a cartridge.

Referring to FIG. 1, a cylindrical rod or a porous substrate other than tobaccco 10 has a deposit thereon of particles 12 of a water-insoluble, hydrophobic, moisture-laden substance activatable by the tobacco smoke to release the moisture. The porous substrate is preferably a cellulosic material such as cellulose acetate tow. The tow is impregnated with the moisture-laden substance and then is formed into a cylindrical rod which is covered by any suitable material 14 such as cigarette paper, common filter tip tubing, or the covering may be a liquid coating composition which is then dried. The coating, of course, must be non-toxic and of a composition which will furnish a dry surrounding layer in the finished product. The rod, having the deposit of the moisture-laden substance deposited on the fibers thereof preferably is made continuously and the surrounding cover or coating 14 applied thereto, following which the coated or covered rod of indeterminate length is cut to predetermined lengths. The ends 16 of the filter may be open or unobstructed. In this form of the invention, a cartridge, designated A, is intended for use in any cigarette or cigar holder. One form of holder which is suitable to accept a cartridge made in accordance with the invention is described in Schreus et al U.S. Pat. No. 2,815,760; granted Dec. 10, 1957.

The particles 12 of the water-insoluble, hydrophobic, moisture-laden substance which are activated by the tobacco smoke as presently known may be generally designated as methylated silicas, and are marketed by Cabot Corporation, Boston, Mass. 02110 under the trademark "Silanox", and by Degussa, Inc., Kearny, N.J. 07032 under the trademark "Aerosil". The product made by Cabot Corporation is a trimethylsilyl group on the surface of the base-fumed silicon dioxide particle after reaction with silane. The reaction changes the surface characteristic of the silicon dioxide from hydrophilic to hydrophobic. The formula is $(CH_3)_3 — Si — O — Si$. The product made by Degussa is essentially the same except that there are two methyl groups instead of three.

In the presence of the hydrophobic, colloidal, methylated silica, water is finely dispersed, so that the fine, mist-like particles are surrounded by the colloidal silica particles to prevent them from reuniting to form larger particles. A substance is obtained which has the appearance of a dry powder. Such dry powder is best obtained by using approximately 10% of the colloidal silica and 90% water. Objects immersed in this material are not wetted, and this emulsion of water in hydrophobic, colloidal, methylated silica may be described as "dry water".

The moving gases or smoke which are less than saturated with moisture will pick up moisture which is released by the described dry water. The temperature of the gases or smoke when reaching the filter having the dry water deposited on the fibers thereof will cause the dry water to release the moisture or water held by the methylated silica.

Figure 2:
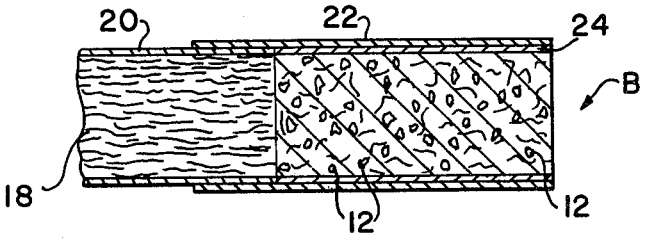
FIG. 2 is a partial vertical cross section of a cigarette provided with a filter made in accordance with the invention.

As previously indicated, the filter for tobacco smoke in accordance with the invention is not limited to its use as a cartridge in a cigarette or cigar holder. The filter also is useful for assembly with a body of finely divided tobacco as the filter tip end of a cigarette to furnish what is in effect a hygroscopic filter for the tobacco. As shown in FIG. 2, a filter, generally designated B, is of the same structure and composition as shown in FIG. 1, except that the filter B is of shorter length than the filter A of FIG. 1. The cartridge form of filter A is useful for as many as 20 cigarettes, whereas the filter B at the end of the body of finely divided tobacco 18 is used for but one cigarette. As is common in the art, the body or rod of tobacco is surrounded by cigarette paper 20 and the tube within which the filter B is situated is surrounded by filter tip material 22 which may have an internal layer of paper 24.

Figure 3:
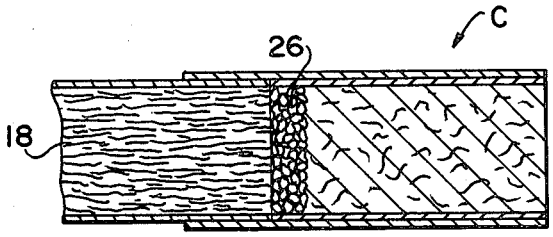
FIG. 3 is a view similar to FIG. 2, except that a layer of the water-insoluble, hydrophobic, moisture-laden substance activatable by tobacco smoke is located between the body of tobacco and the fibrous portion of the filter instead of having such substance in the form of a deposit on the fibers as shown in FIGS. 1 and 2.

In the embodiment of the invention illustrated in FIG. 3, the water-insoluble, hydrophobic, moisture-laden substance is provided as a layer 26 between the body of finely divided tobacco 18 and a body C of fibrous filter material which may be any suitable porous substrate. Preferably, the fibrous material is a cellulose acetate tow. In this form of the invention, the tobacco smoke must travel through the layer of particles of the water-insoluble, hydrophobic, moisture-laden substance in the form of the colloidal methylated silica-water system as hereinbefore described. This layer of particles at the juncture of the tobacco body 18 and fibrous body C is most effective to furnish a moisture-laden or cool smoke. Tobacco burns at approximately 800° C. At the mouth end of the filter, the temperature is approximately 40° C. In the area of the layer 26 of the dry water, the temperature is approximately 180° to 200° C. The moving gases or smoke which are less than saturated when they reach the layer 26 pick up the moisture released by the particles of dry water.

Figure 4:
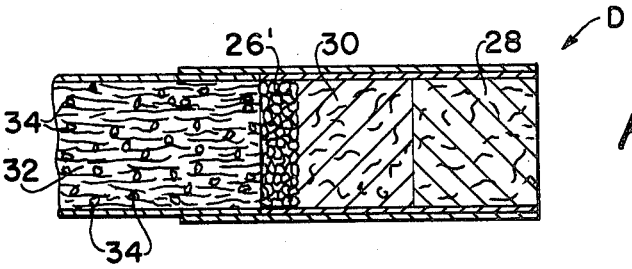
FIG. 4 is a view similar to FIG. 3, except that the filter includes two kinds of fibrous materials.

In the form of the invention illustrated in FIG. 4, a layer 26' of particles of dry water is positioned between the body of tobacco 18 and a filter body generally designated D. In this form of the invention, the filter body D is a composite of two fiber sections 28 and 30. The fiber section 28 is any suitable porous substrate such as cellulose acetate tow. The fiber section 30, however, comprises synthetic, inorganic water-insoluble anhydrous fibers having a positive zeta potential at the pH of tobacco smoke, as described in my pending application Ser. No. 479,104; filed June 13, 1974. Preferably, the fibers are of alumina, zirconia, alumina-silica or mixtures thereof. A cigarette having fibers of this kind in the filter end thereof preferably has related thereto a body of tobacco 32 which has a deposit thereon of particles 34 of dry water, except that the dry water is of the type which is negatively charged so that negative charges are imparted to the particulates in the smoke. As a result, the fibers in the filter section 30 having the positive zeta potential at the pH of tobacco smoke act to coalesce the colloidally dispersed negative particles in the tobacco smoke to enlarge them and render them more easily filterable.

It will be apparent that the composite filter D may be made entirely of the fibers having the positive zeta potential at the pH of tobacco smoke as above described.

Also, instead of the fibers having a positive zeta potential at the pH of tobacco smoke, a porous substrate may be used which has a deposit thereon of a positively charged, water-insoluble, hydrophobic, oleophilic, coalescing agent as described in my pending application Ser. No. 479,103; filed June 13, 1974, and filter material of this kind may be used in lieu of the section of fibers 30 or to entirely replace the described sections 28 and 30.

Figure 5:
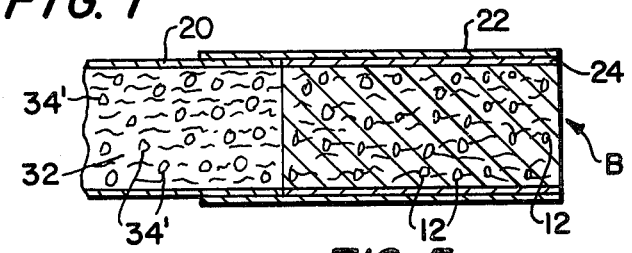
FIG. 5 is a view similar to FIG. 2, except that the tobacco has a deposit thereon of the same material as present in the filter.

In the form of the invention illustrated in FIG. 5, a filter B as shown in FIG. 2 is associated with a body of tobacco having a deposit thereon of the same substance as deposited on the fibers of the filter. Thus, with like reference characters indicating like parts, the filter B comprises a porous substrate of cellulose tow or the like having a deposit thereon particles 12 of the water-insoluble, hydrophobic, moisture-laden substance, hereinbefore referred to as "dry water". The tobacco 32 also has deposited thereon particles 34' of the "dry water", which as previously described is specifically an emulsion of water in hydrophobic, colloidal, methylated silica.

For the most effective utilization of the dry water in the filter, whether used as a deposit on a porous substrate as shown in FIGS. 1, and 5, or as a separate layer as shown in FIGS. 3 and 4, a free-moisture absorbent is used in conjunction with the dry water. Preferably, such absorbent is calcium silicate which is mixed with the colloidal methylated silica-water system. Other free moisture absorbents which are suitable, all in finely powdered form, are sintered kaolin clay, pumice, silica gel and alumina.

The amount of dry water used as a deposit on a porous substrate as shown in FIGS. 1, and 5 and as a layer between the bodies of tobacco and fibrous filter material as shown in FIGS. 3 and 4 may be of any suitable amount. It has been found that 1 to 10 milligrams of the methylated silica is suitable as both a coating or impregnant for the porous substrate or as a separate layer between the tobacco and filter bodies. As indicated in the preferred embodiment, 10% of the system is methylated silica and 90% is water. As indicated, where the preferred calcium silicate is used to absorb any free water which did not go into the colloidal phase of the dry water, 0.1 gram of calcium silicate is used for each gram of the methylated silica and 9 grams of water.

It is believed that the advantages and improved results afforded by the filters of the invention and by a cigarette comprising tobacco associated with the described filters will be apparent from the foregoing description of the preferred embodiments of the invention. Various changes and modifications may be made without departing from the spirit and scope of the invention as sought to be defined from the following claims.

I claim:

1. In combination, a body of divided tobacco to be burned, a filter for the tobacco smoke resulting from the burning, the tobacco having a deposit thereon of particles of a water-insoluble, hydrophobic, moisture-laden substance, the major ingredient of the substance being water, the filter comprising a porous substrate having a deposit thereon of particles of a water-insoluble, hydrophobic, moisture-laden substance activatable by the tobacco smoke to release the moisture, the major ingredient of the substance being water.

2. The combination according to claim 1, wherein the deposit on the tobacco is a colloidal methylated silica-water system, the particles of methylated silica being dispersed around the water.

3. The combination according to claim 1, wherein the methylated silica and water are present in the amounts, by weight, of approximately 10% and 90%, respectively.

4. The combination according to claim 2, wherein the deposit on the porous substrate is a colloidal methylated silica-water system, the particles of methylated silica being dispersed around the water.

5. The combination according to claim 4, wherein the methylated silica and water are present in the amounts, by weight, of approximately 10% and 90%, respectively.

6. The combination according to claim 4, wherein the porous substrate is cellulosic material.

7. The combination according to claim 5, wherein the porous substrate is cellulosic material.

8. In combination, a body of divided tobacco to be burned, a filter for the tobacco smoke resulting from the burning, and a layer of particles of a water-insoluble, hydrophobic, moisture-laden substance activatable by the tobacco smoke to release the moisture between the body of tobacco and the filter, the major ingredient of the substance being water.

9. The combination according to claim 8, wherein the layer comprises a colloidal methylated silica-water system, the particles of methylated silica being dispersed around the water.

10. The combination according to claim 9, wherein the methylated silica and water are present in the amounts, by weight, of approximately 10% and 90%, respectively.

11. The combination according to claim 9, wherein the particles are negatively charged.

12. The combination according to claim 11, wherein the tobacco has a deposit thereon of particles of a water-insoluble, hydrophobic, moisture-laden, negative charge-imparting substance, and the filter comprises synthetic, inorganic, water-insoluble, anhydrous fibers having a positive zeta potential at the pH of tobacco smoke.

13. The combination according to claim 12, wherein the deposit on the tobacco is a colloidal methylated silica-water system, the particles of methylated silica being dispersed around the water.

14. The combination according to claim 13, wherein the methylated silica and water on the tobacco are present in the amounts, by weight, of approximatey 10% and 90%, respectively.

15. The combination according to claim 13, wherein the fibers are selected from the group consisting of alumina, zirconia, alumina-silica, and mixtures thereof.

16. The combination according to claim 15, wherein the colloidal methylated silica-water system of the layer has calcium silicate mixed therewith.

17. The combination according to claim 12, wherein the fibers are selected from the group consisting of alumina, zirconia, alumina-silica, and mixtures thereof.

18. The combination according to claim 17, wherein said layer includes a free-moisture absorbent.

19. The combination according to claim 17, wherein the colloidal methylated silica-water system of the layer has calcium silicate mixed therewith.

20. The combination according to claim 9, wherein the colloidal methylated silica-water system has calcium silicate mixed therewith.

21. The combination according to claim 8, wherein the layer includes a free moisture absorbent.

22. The combination according to claim 8, wherein the tobacco has a deposit thereon of particles of a water-insoluble, hydrophobic, moisture-laden, negative charge-imparting substance, the major ingredient of the substance being water, and the filter comprises synthetic, inorganic, water-insoluble, anhydrous fibers having a positive zeta potential at the pH of tobacco smoke.

23. The combination according to claim 22, wherein the deposit on the tobacco is a colloidal methylated silica-water system, the particles of methylated silica being dispersed around the water.

24. The combination according to claim 23, wherein the methylated silica and water on the tobacco are present in the amounts, by weight, of approximately 10% and 90%, respectively.

25. The combination according to claim 23, wherein the fibers are selected from the group consisting of alumina, zirconia, alumina-silica, and mixtures thereof.

26. The combination accordng to claim 22, wherein the fibers are selected from the group consisting of alumina, zirconia, alumina-silica, and mixtures thereof.

* * * * *